US005916094A

United States Patent [19]

Gretz

[11] Patent Number: 5,916,094

[45] Date of Patent: Jun. 29, 1999

[54] CATHEDRAL CEILING FIXTURE MOUNTING BLOCK

[75] Inventor: Thomas J. Gretz, Clarks Summit, Pa.

[73] Assignee: Arlington Industries, Inc., Scranton, Pa.

[21] Appl. No.: 09/026,195

[22] Filed: Feb. 19, 1998

[51] Int. Cl.[6] ..... E04F 19/00

[52] U.S. Cl. ..... 52/39; 248/342; 362/147

[58] Field of Search ..... 52/28, 39, 27; 362/147, 150, 148, 151, 404; 248/220.1, 342, 343, 344

[56] References Cited

U.S. PATENT DOCUMENTS 5,592,788 1/1997 Corridon ..... 52/28

*Primary Examiner*—Carl D. Friedman
*Assistant Examiner*—Dennis L. Dorsey

[57] ABSTRACT

A one-piece fixture mounting block to be used in conjunction with a standard ceiling mounted electrical box for mounting a light fixture or ceiling fan in the center of a cathedral ceiling. The mounting block features vertical walls which offer an upper perimeter that conforms with an 18° ceiling angle. The mounting block can easily be modified to conform to an 8° ceiling angle.

6 Claims, 4 Drawing Sheets

CATHEDRAL CEILING FIXTURE MOUNTING BLOCK

FIELD OF THE INVENTION

This invention relates to ceiling mounting fixtures and in particular, to an improved cathedral ceiling block that is easy to install, accommodates two common cathedral ceiling pitches, and provides a decorative mounting block that is aesthetically pleasing to the eye and hides from view the wiring connections within the block.

BACKGROUND OF THE INVENTION

Ceiling light fixtures or fans are typically constructed with flat base members for mounting on flat ceilings. It is common however for buildings to be constructed with angular surfaces such as cathedral or vaulted ceilings, which call for special adaptations to allow use of standard ceiling fans and standard light fixtures. For cathedral ceilings, it is commonly desirable to mount the light fixture or fan at the apex of the ceiling to provide a balanced appearance and a pleasing visual effect and also to achieve the greatest efficiency.

Traditionally, lights or fans mounted at the apex of a cathedral ceiling are either suspended from a bracket or are attached to an electrical box which is anchored to the truss or load bearing member in the ceiling. A housing or boot is then constructed around the exposed electrical box or bracket to cover the wiring and create a pleasing aesthetic effect.

Other methods include the use of a standard mounting block, which has a planar, horizontal lower surface and either a planar or angular upper surface. The upper surface can be cut away as needed to provide an exact fit to the pitch of the cathedral ceiling. The block is typically constructed of a material that is easy to cut, such as styrofoam. A deficiency of the standard mounting block is that it is difficult to reproduce the exact pitch of the ceiling on the top of the mounting box, and this frequently leads to unsightly gaps from an insufficient fit.

Another method, as cited in U.S. Pat. No. 5,592,788, for example, cites a multi-layered mounting block which includes a bottom member having a planar, horizontal lower surface, and inverted V-shaped upper surface, and several successive upper members having various pitches to conform to a plurality of possible ceiling pitches. This type of arrangement, while accommodating several different ceiling pitches, requires the use of some type of aligning mechanism to keep the successive upper members aligned with each other and with the bottom member and keeping all sides flush. The alignment mechanism, whether dowels placed through holes or pitch connectors, becomes very complex and difficult to align.

Therefore, as shown by these several limitations, cathedral ceiling fixture mounting systems of the present art have not proven fully satisfactory for enabling easy installation of cathedral ceiling fixtures.

SUMMARY OF THE INVENTION

In accordance with the present invention, there is provided a cathedral ceiling fixture mounting block which permits an aesthetically pleasing attachment of standard ceiling lights and fans to cathedral ceilings of various pitches. The mounting block is typically of simple, onepiece molded construction and can accommodate two pitches commonly employed in cathedral ceilings. The mounting block includes thick and thin vertical wall portions on the sides which will fit flush with the pitch of the cathedral ceiling. For a higher pitched cathedral ceiling, the thin wall portion remains in place to accommodate the higher pitch of the ceiling. For a lesser pitched cathedral ceiling, the thin wall portion is cut away to expose a second pitch provided by the thick wall portion which fits flush with the smaller pitched cathedral ceiling.

OBJECTS AND ADVANTAGES

A principal object of the present invention is to provide a cathedral ceiling fixture mounting block that is of simple, one-piece molded construction and is easy to use.

It is also desired to provide a cathedral ceiling fixture mounting block that is aesthetically appealing to the eye.

A further objective is to provide a cathedral ceiling fixture mounting block that provides a planar, horizontal, lower surface to allow flush mounting of standard flat ceiling lighting devices and fans.

Another objective is to provide a cathedral ceiling fixture mounting block that will accommodate cathedral ceilings of more than one pitch.

It is also desired to provide a cathedral ceiling fixture mounting block that fits flush against the pitched surface of the ceiling at the apex of the ceiling and all along the perimeter of the mounting block at its juncture with the ceiling.

DESCRIPTION OF THE INVENTION

Figure 1:
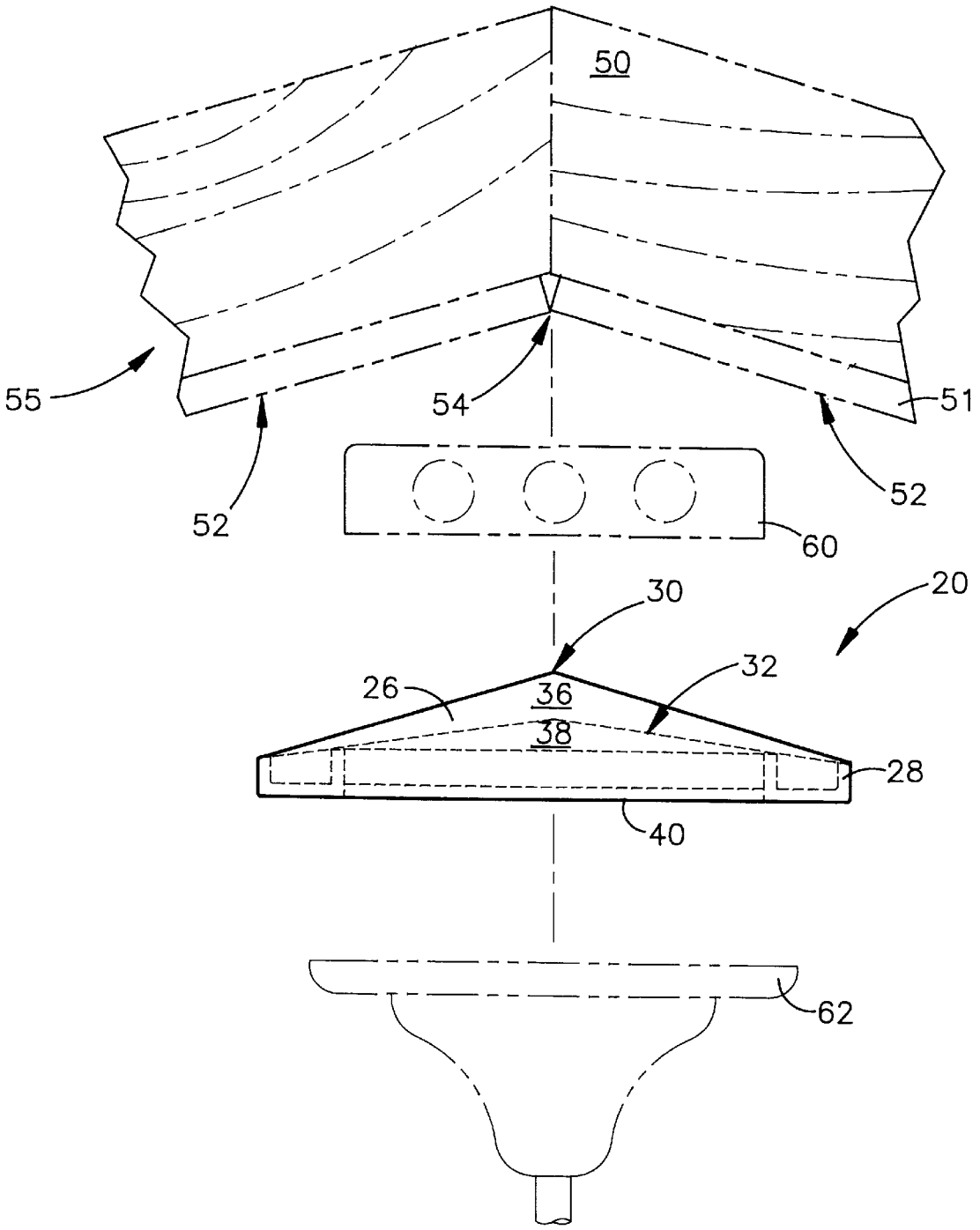
FIG. 1 is an exploded view showing the present invention, an electrical box, and the topmost portion of a fan all centered at the apex of a cathedral ceiling and in alignment with each other.

FIG. 1 is an exploded view showing the one-piece fixture mounting block 20 of the present invention with an electrical box 60 and the topmost portion of a fan 62 all centered at the apex 54 of a cathedral ceiling 55 and in alignment with each other. As depicted in FIG. 1, a typical cathedral ceiling consists of a truss member 50, a drywall layer 51 over the truss member 50, and a ceiling surface 52 consisting of the exposed, lower surface of the drywall 51. The cathedral ceiling surface 52 comes together at a certain angle at the apex 54 of the cathedral ceiling 55.

Figure 2:
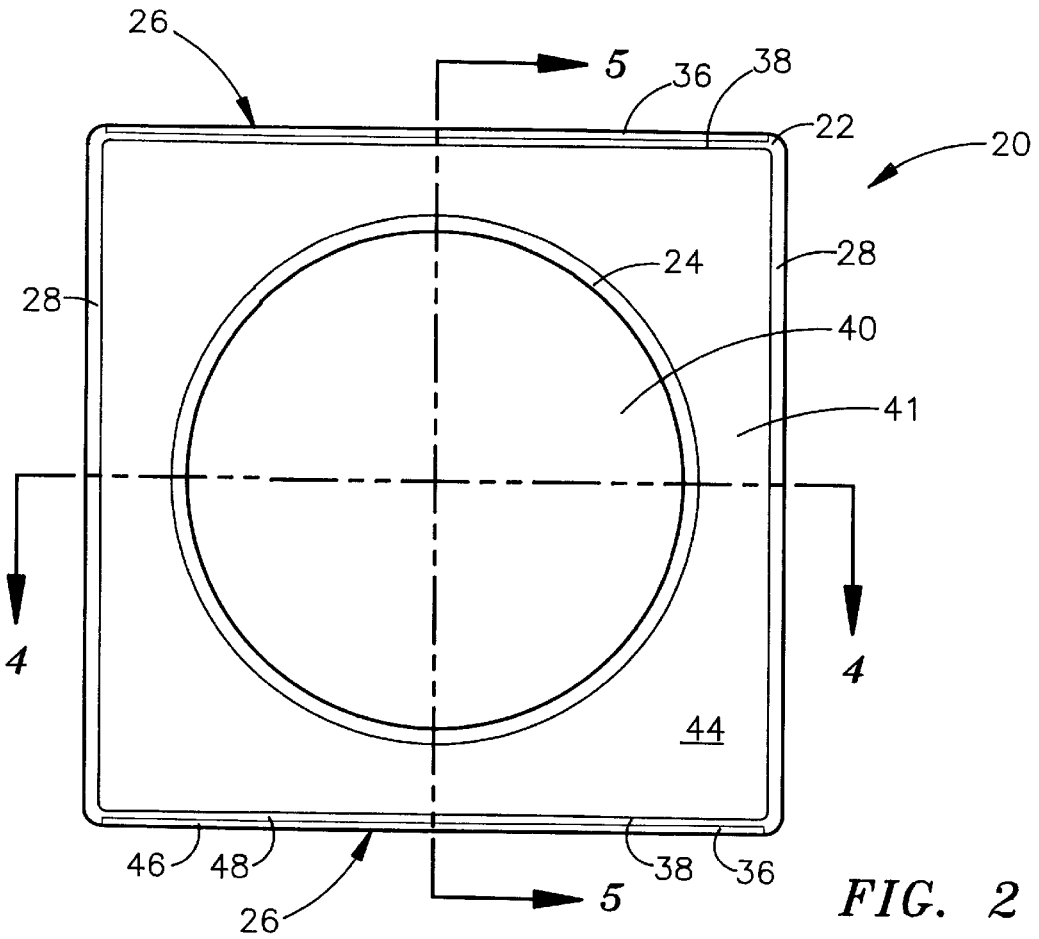
FIG. 2 is a top view of the present invention.

A top view of the fixture mounting block 20 is given in FIG. 2. The base plate 41 includes a central bore 40 which is surrounded by an upward extending lip which extends from the upper surface 44 of the base plate 41 and forms an inner wall 24 within the four outer vertical walls 22. This inner wall serves to reinforce the block 20 around central bore 40. Typically, the block 20 is approximately six inches square with a central bore 40 approximately four inches in diameter. The material is a plastic material such as polyvinyl chloride. A first set of opposing walls 28, shown at the left and right sides of FIG. 2, are flat walls which have top edges parallel with the plane of the base plate 41. A second set of opposing walls 26, shown at the top and bottom of FIG. 2, are level with the flat walls at their junctures, but are angled upwardly therefrom to a central apex along each wall 26.

Figure 4:
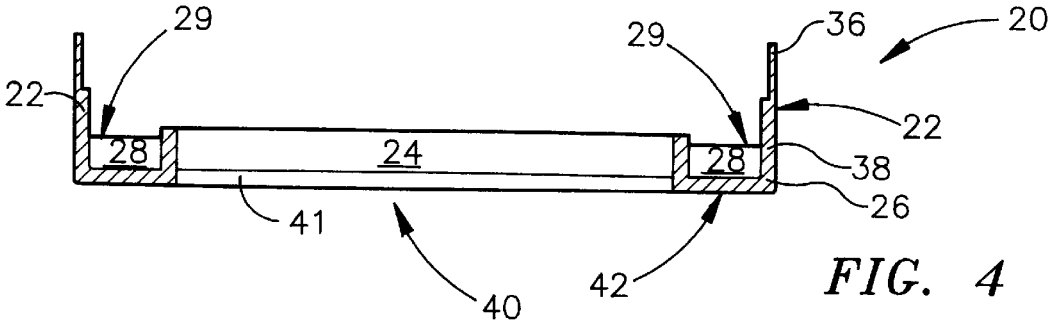
FIG. 4 is a cutaway view of the cathedral ceiling fixture mounting block taken along lines 4—4 of FIG. 2 and showing the side of the mounting block that accommodates the flat surface of the cathedral ceiling.

FIG. 4 is a cutaway view of the cathedral ceiling fixture mounting block 20 taken along lines 4—4 of FIG. 2 and showing the half of the mounting block 20 that will accommodate the flat surface of the cathedral ceiling. The flat wall 28, shown extending from the base plate 41, has an upper beveled edge 29 that is parallel with the horizontal lower surface 42 of base plate 41. Inner wall 24 is a lip extending from base plate 41 and surrounding central bore 40. The second set of opposing vertical walls 22, shown at the left and right sides of FIG. 4, include thinner upper wall portions 36 and thicker upper wall portions 38. The thinner upper wall portion 36 may be cut away to change the geometry of the top perimeter of the outer vertical walls 22 thereby allowing the new perimeter to accommodate a cathedral ceiling of a different angle than that accommodated by the outer perimeter defined by thinner upper wall portion 36. The beveled edge 29 is beveled to the same angle as line 31 of lower wall portion 38.

Figure 3:
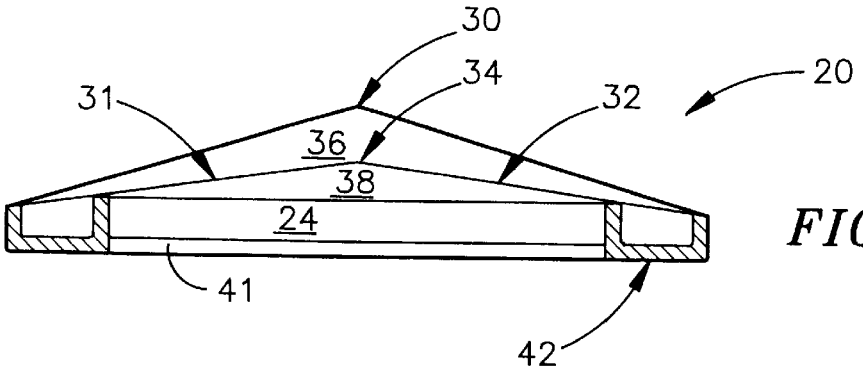
FIG. 3 is a cutaway view of the cathedral ceiling fixture mounting block taken along lines 5—5 of FIG. 2 and showing the side of the mounting block that accommodates the pitched surface of the cathedral ceiling.

FIG. 3 is a cutaway view of the cathedral ceiling fixture mounting block 20 taken along lines 5—5 of FIG. 2 and showing the half of the mounting block 20 that includes one of the angular walls 26 which will accommodate the pitched surface of a cathedral ceiling. As shown in FIG. 2, the angular wall 26 includes two wall thicknesses including a thinner upper wall portion 36 and a thicker lower wall portion 38. The thinner upper wall portion 36 is typically angled at 18° from the horizontal plane (not shown) parallel with base plate 41 and through central apex 30. The thicker lower wall portion 38 is typically angled at 8° from the horizontal plane (not shown) parallel with base plate 41 and through central apex 34. Fixture mounting block 20 will therefore accommodate cathedral ceilings of two different pitches. With thinner wall section 36 in place, a cathedral ceiling having an 18° pitch will be accommodated. With thinner wall section 36 cut away to expose the top edge of thicker lower wall section 38, a cathedral ceiling having an 8° pitch will be accommodated. As shown in FIG. 3, inner wall 24 does not extend beyond the planes 31, 32 defined by the juncture of the thinner upper wall portion 36 and the thicker lower wall portion 38. With thinner wall portion 36 cut away, inner wall 24 will not interfere with an accommodating fit between the edge of the thicker lower wall portion 38 and the surface of a cathedral ceiling that is angled at an 8° pitch.

As shown in FIG. 2, an outer perimeter 46 is defined by the first set of vertical walls 28 and the thinner wall portions 36 of the second set of vertical walls 26 to accommodate a fit to a cathedral ceiling angled at a pitch of 18°. Also shown in FIG. 2, an inner perimeter 48 is defined by the first set of vertical walls 28 and the thicker wall portions 38 of the second set of vertical walls 26 to accommodate a fit to a cathedral ceiling angled at a pitch of 8°.

As shown in FIG. 4, at the juncture of the angular wall 26 and the flat wall 28, both the thinner upper wall portion 36 and the thicker lower wall portion 38 of the angular wall are level with the flat wall 28. From this point of juncture, the angular walls 26 extend upwardly at a constant angle to a central apex. The thinner upper wall section extends upwardly to central apex 30. The thicker lower wall section extends upwardly to central apex 34.

As shown in FIG. 4, the thicker lower wall portion 38 is typically 0.125 inch thickness. Thinner upper wall portion 36 is typically 0.062 inch thickness.

Referring to FIG. 1, the present invention is used in conjunction with a standard ceiling electrical box 60. The electrical box 60 is mounted with screws (not shown) or other appropriate fasteners to the load bearing member of a cathedral ceiling 55 such as the truss member 50 shown in FIG. 1. The fixture mounting block 20 is then positioned with the apex 30 of the mounting block 20 aligned with the apex 54 of the cathedral ceiling 55. An electrical light or fan, such as the topmost portion of a fan 62 shown in FIG. 1, is then brought in close proximity with the desired mounting position, wiring connections are completed, and screws or other appropriate fasteners (not shown) are positioned through the fan 62, through the central bore 40 of the fixture mount 20, and into an appropriately threaded boss (not shown) within the electrical box 60. The screws are then tightened until both the electrical device 62 and fixture mount 20 are tightened against the electrical box 60 and thereby against the surface 52 of the cathedral ceiling. In its final configuration, the fixture mount 20 therefore conforms to the shape of the cathedral ceiling 55, with flat walls 28 and angled walls 26 firmly against the ceiling surface at their topmost extent. The fixture mount 20 can accommodate a lower pitched cathedral ceiling 55 by cutting away the thinner upper wall portions 36 thereby exposing a second pitched surface defined by the thicker lower wall portions 38.

Figure 5:
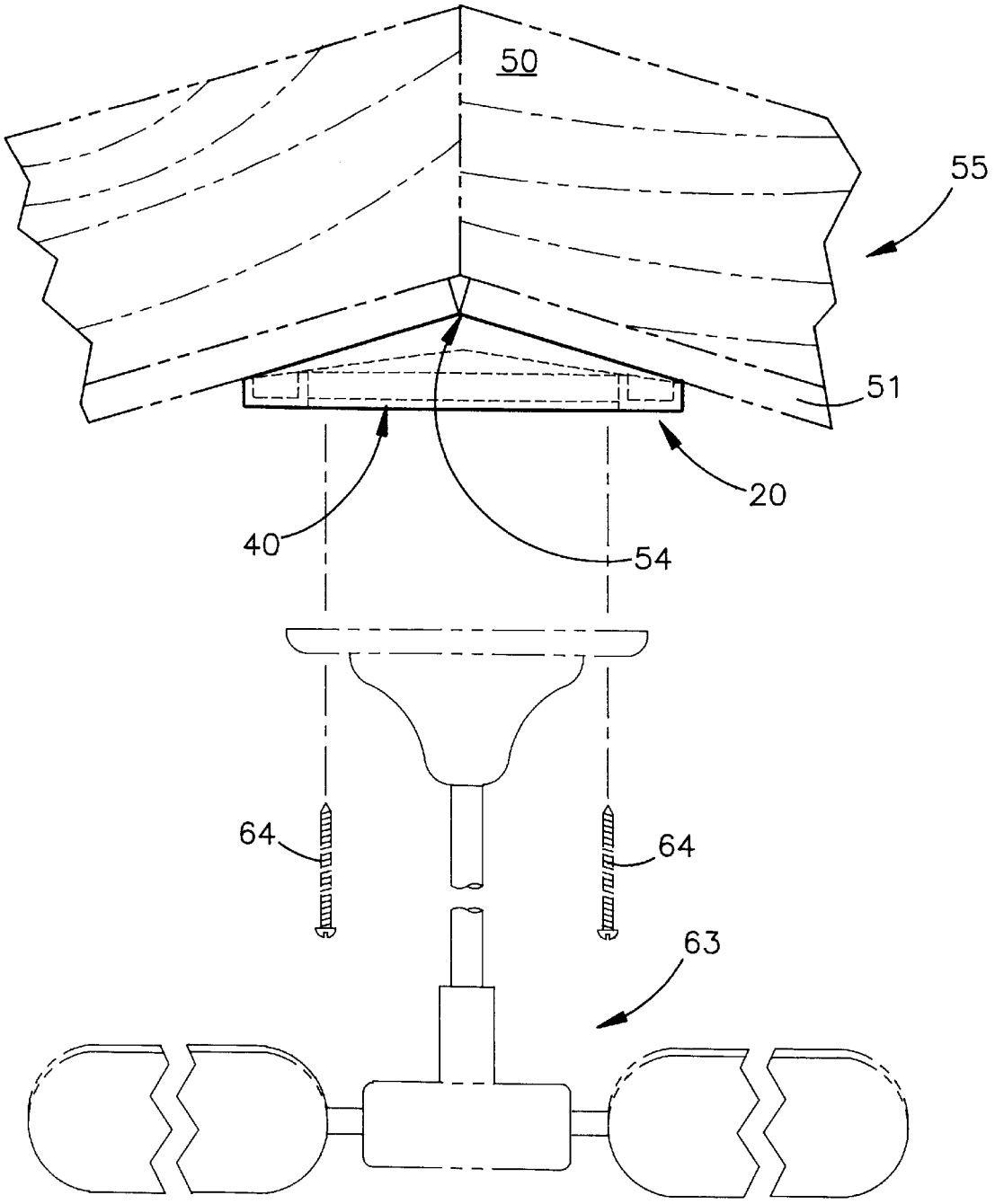
FIG. 5 is an exploded view showing the present invention in alignment with a ceiling fan and the apex of a cathedral ceiling and depicting screws in proper alignment through the central bore of the fixture mount.

FIG. 5 is an exploded view showing the present invention in alignment with a ceiling fan 63 and the apex 54 of a cathedral ceiling 55 and depicting screws 64 in proper alignment through the central bore 40 of the fixture mount 20. The screws typically 64 fasten into threaded bosses (not shown) in the electrical box (not shown) that is fastened to the truss member 50 of the cathedral ceiling 55. If the fan or other electrical device is heavy, the screws 64 may be fastened through the electrical box and into the truss 50 or load bearing member of the cathedral ceiling 55.

Figure 6:
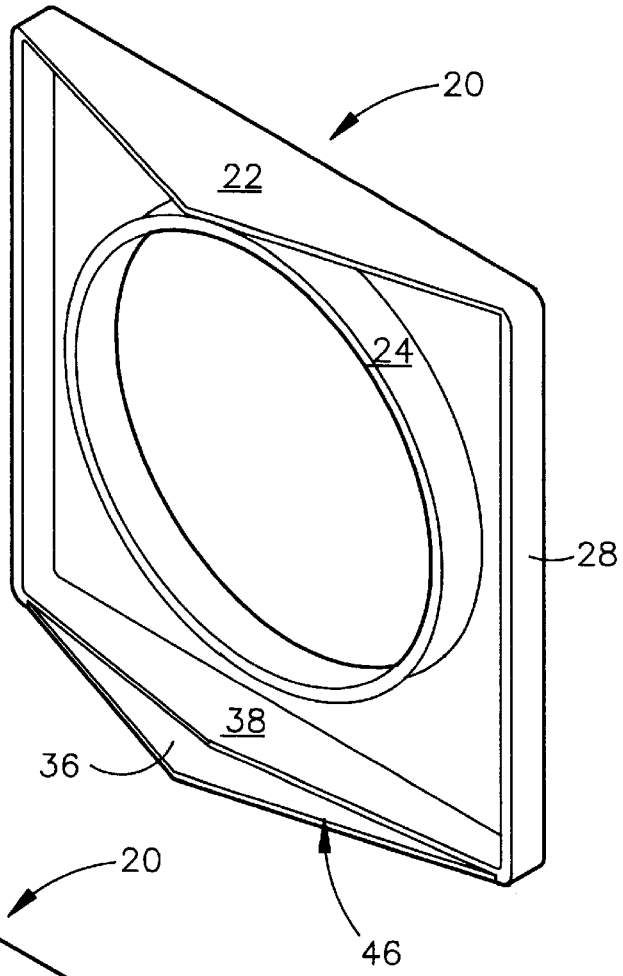
FIG. 6 is a perspective view of the present invention with the outer perimeter or first upper edge intact, to accommodate an 8° cathedral ceiling.

In FIG. 6, a perspective view of the present invention, the ceiling fixture block 20 has the entire outer wall 22 intact, including the flat wall 28 and both thinner upper wall portion 36 and thicker lower wall portion 38 to expose a first upper edge 46 which will accommodate an 180 cathedral ceiling.

Figure 7:
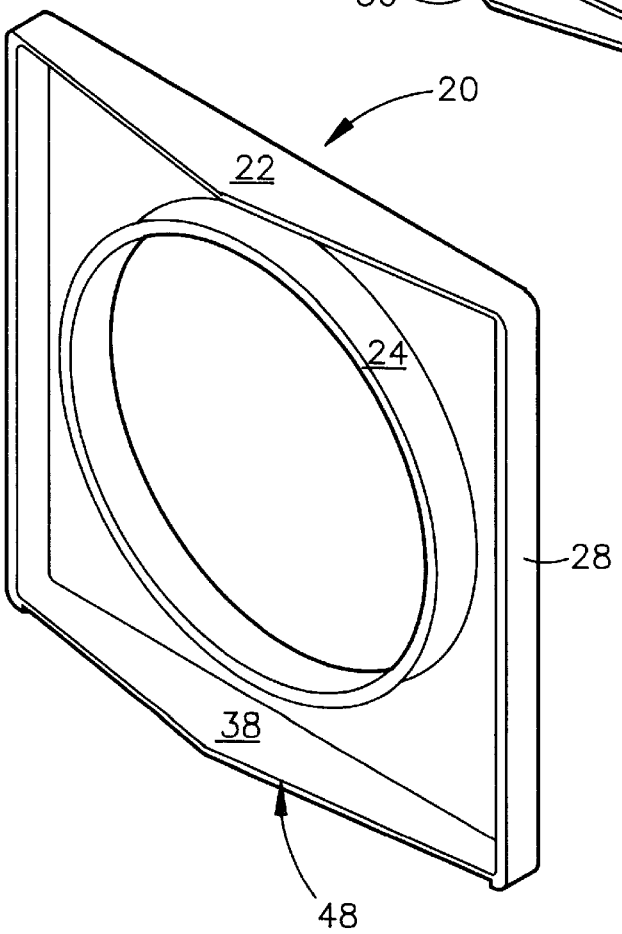
FIG. 7 is a perspective view of the present invention with the outer perimeter or first upper edge intact cut away to reveal the inner perimeter or second upper edge, to accommodate an 8° cathedral ceiling.

In FIG. 7, a perspective view of the present invention with the thinner upper wall portion cut away, the ceiling fixture block 20 has only a portion of the outer wall 22 intact, including the flat wall 28 and thicker lower wall portion 38 to expose a second upper edge 48 which will accommodate an 8° cathedral ceiling.

Although there has been shown and described an example of what is at present considered the preferred embodiment of a one-piece fixture mounting block for a cathedral ceiling, it will be obvious to those skilled in the art that various changes and modifications may be made therein without departing from the scope of the invention as defined by the appended claims.

What is claimed is:

1. A one-piece fixture mounting block for a cathedral ceiling comprising:

a base plate including a planar, horizontal lower surface;

four vertical walls perpendicular to said lower surface, a first set of said vertical walls being opposite each other and having top edges parallel with said lower surface, a second set of said vertical walls being opposite each other and having at least two wall thicknesses including a thicker lower wall portion and a thinner upper wall portion, said thinner upper wall portion being even with said first set of vertical walls at their junctures and angled upwardly at a first pitch therefrom to a central apex, said thicker lower wall portion being even with said first set of vertical walls at their junctures and angled upwardly therefrom at a second, lower pitch than said thinner wall portions;

a first upper edge defined by said first set of vertical walls and said thinner wall portions of said second set of vertical walls;

a second upper edge defined by said first set of vertical walls and said thicker wall portions of said second set of vertical walls; and a central bore through said lower horizontal surface.

2. The one-piece fixture mounting block of claim 1 wherein said first pitch is 18° from horizontal and said second pitch is 8° from horizontal.

3. The one-piece fixture mounting block of claim 1 wherein said second upper edge becomes exposed by cutting away said thinner wall portion at its juncture with said thicker wall portion.

4. The one-piece fixture mounting block of claim 1 wherein said thinner wall portion of said second set of vertical walls is approximately 0.062 inch and said thicker wall portion of said second set of vertical walls is approximately 0.125 inch.

5. The one-piece fixture mounting block of claim 1 wherein said base plate includes an upward extending lip which forms an inner wall around said central bores said upward lip extending no farther than the plane defined by said second upper edge.

6. The one-piece fixture mounting block of claim 1 wherein said top edges of said first set of vertical walls are beveled to said lower pitch.

* * * * *